US006336341B1

(12) United States Patent
McGraw et al.

(10) Patent No.: US 6,336,341 B1
(45) Date of Patent: Jan. 8, 2002

(54) COOLING SYSTEM FOR ICE CHEST

(76) Inventors: Thomas L. McGraw, 390 Edge Ave., Valparaiso, FL (US) 32580; Terrance L. McGraw, 7651 Blair Dr., Zephyrhills, FL (US) 33544; Jon Franke, 4270 Laurel Crest Ct., Mulberry, FL (US) 33860

( * ) Notice: Subject to any disclaimer, the term of this patent is extended or adjusted under 35 U.S.C. 154(b) by 0 days.

(21) Appl. No.: 09/757,094

(22) Filed: Jan. 10, 2001

(51) Int. Cl.[7] ..... F25D 3/02
(52) U.S. Cl. ..... 62/420; 62/425; 62/457.2
(58) Field of Search ..... 62/420, 425, 426, 62/404, 457.2, 457.7, 371, 530

(56) References Cited

U.S. PATENT DOCUMENTS 1,966,011 A * 7/1934 HUbbell ..... 165/69
2,584,442 A * 2/1952 Frie ..... 165/129
4,468,932 A 9/1984 Bullard ..... 62/421
5,685,165 A 11/1997 Bigelow, Jr. ..... 62/420
5,709,104 A 1/1998 Howcroft ..... 62/457.1

* cited by examiner

*Primary Examiner*—Henry Bennett
*Assistant Examiner*—Melvin Jones
(74) *Attorney, Agent, or Firm*—Peter Loffler

(57) ABSTRACT

A cooling system for use with a typical ice container uses a pump that is disposed within a fluid held within the ice container. The pump pumps the fluid through a radiator located on a top cover of the ice container while a fan blows across the radiator. A plenum directs the cool air produced by the device. The fan can draw at least some of its air from within the ice container and can be thermostatically controlled.

15 Claims, 3 Drawing Sheets

COOLING SYSTEM FOR ICE CHEST

BACKGROUND OF THE INVENTION

1. Field of the Invention

The present invention relates to a cooling system that is used with a portable ice chest.

2. Background of the Prior Art

Spending the summer outdoors for picnics, fishing etc., is a popular pastime for many people. While such activities tend to be fun and memorable for most, a problem is experienced by many. The summer heat and humidity can lessen the degree of enjoyment or can curtail the time spent outside by the pleasure seekers. Most activities loose their enjoyment factor whenever the participant is suffering from heat exhaustion.

In order to combat the punishing outdoor heat and humidity, many steps can be taken. The activity can be scheduled at an off-peak time so that the most brutal heat is not experienced. This solution has only limited availability as some activities cannot be effectively scheduled at off-peak hours or the participants cannot attend during the desired hours. Some activities tend to be day long and therefore cut across non-peak as well as peak heat hours.

Another solution is to periodically escape the outdoors and cool off either in an air conditioned building or a running vehicle. Unfortunately, this solution can be very impractical for many activities such as camping or fishing in a small boat. Additionally, this tends to diminish the overall experience for the activity participants.

Therefore, the outdoor heat and humidity must be tackled head-on. Many devices have been proposed in order to accomplish this task. However, many prior art devices tend to be unduly cumbersome in size, making use of such devices limiting. Other devices have only a marginal effect on combating the heat, while other devices are unduly complex in design and operation rendering such devices impractical to own and operate.

Therefore, there is a need in the art for a device that can combat heat and humidity in an outdoor environment. Such a device must not be unduly cumbersome in size and weight, and must offer adequate cooling capacity. Such a device must not be unduly complex in design or operation.

SUMMARY OF THE INVENTION

The cooling system for an ice chest of the present invention addresses the aforementioned needs in the art. The cooling cooler offer effective cooling capacity to a user in a relatively small size. The device is relatively simple in design and operation and is relatively easy to use. The device can also be used to providing heating if a user desires heating instead of cooling.

The cooling system for an ice chest of the present invention is comprised of a container adapted to hold a fluid such as water (hot or cold) as well as ice therein. A base having a first opening therein, is positioned on the container over an open top of the container. A radiator having an inlet and an outlet, is attached to the base. A pump is disposed within the container and is in fluid flow communication with the fluid. A first hose is fluid flow connected with the inlet of the radiator and with the pump. A second hose is fluid flow connected with the outlet of the radiator, the second hose passes through the first opening. A fan is attached to the base proximate the radiator so that the fan blows across the radiator. A power source is electrically connected to the fan and to the pump. A plenum is attached to the base and is positioned over the fan and the radiator. The power source can be a battery, a solar collector, or a plug which can be either a wall plug or a vehicle cigarette lighter plug. A switch is disposed between the power source and the fan and between the power source and the pump for controlling operation of each element. A thermostat can be electrically connected to the switch for controlling operation of the switch based upon the reading of the thermostat. The thermostat is attached to the plenum proximate the radiator. The container rests upon a drip pan. A third hose can be secured within a third opening located in the base while a fourth hose can be secured within a fourth opening located in the container. The fourth hose may have a check valve disposed therein. A second opening can be disposed within the plenum, while a filter is attached to the plenum to cover the second opening. A groove is disposed within the base and extends from proximate the radiator to an edge of the base.

BRIEF DESCRIPTION OF THE DRAWINGS

Similar reference numerals refer to similar parts throughout the several views of the drawings.

DESCRIPTION OF THE PREFERRED EMBODIMENT

Figure 1:
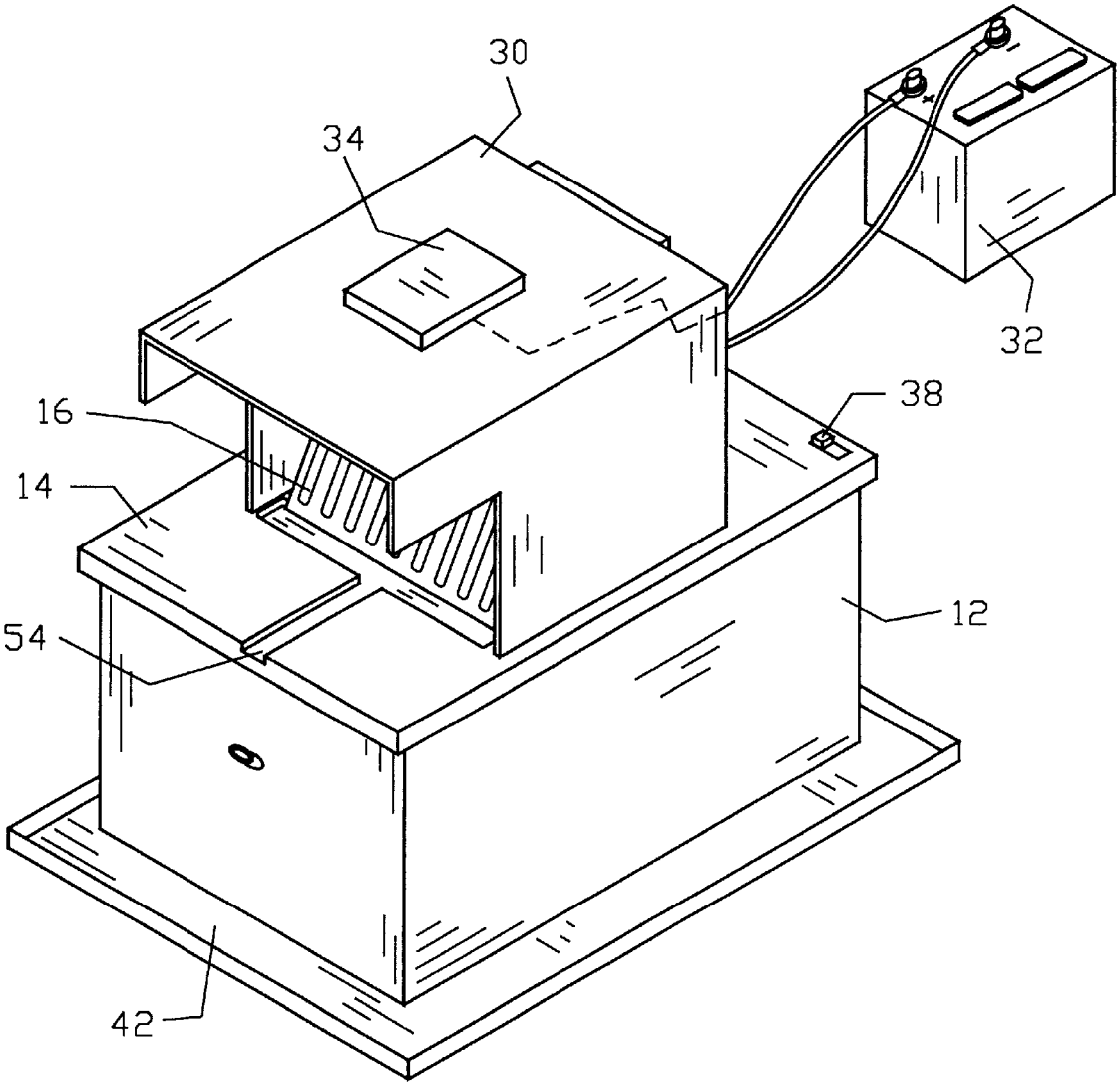
FIG. 1 is a perspective view of the cooling system for an ice chest of the present invention.
Figure 2:
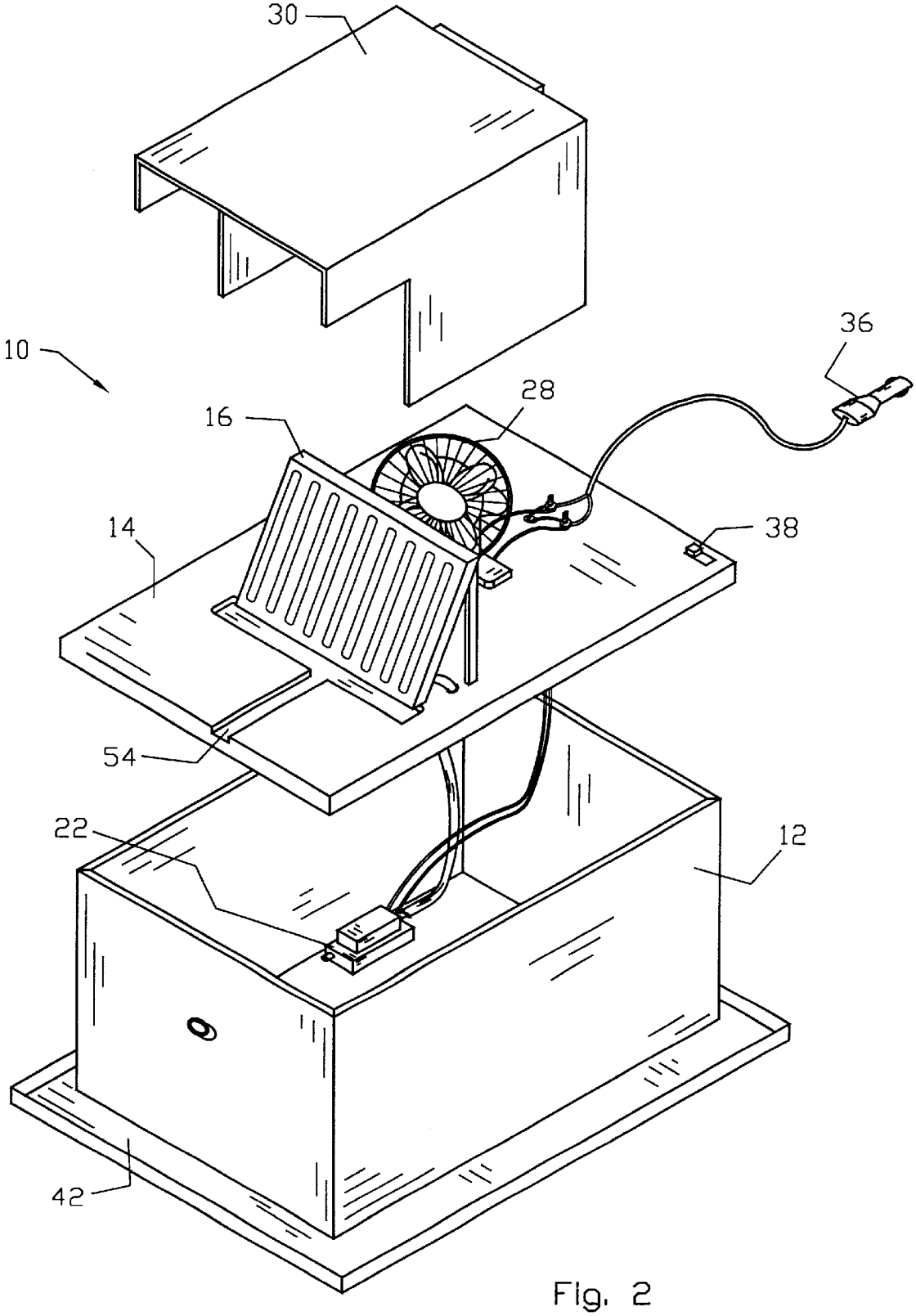
FIG. 2 is a partially exploded view of the cooling system for an ice chest of the present invention.
Figure 3:
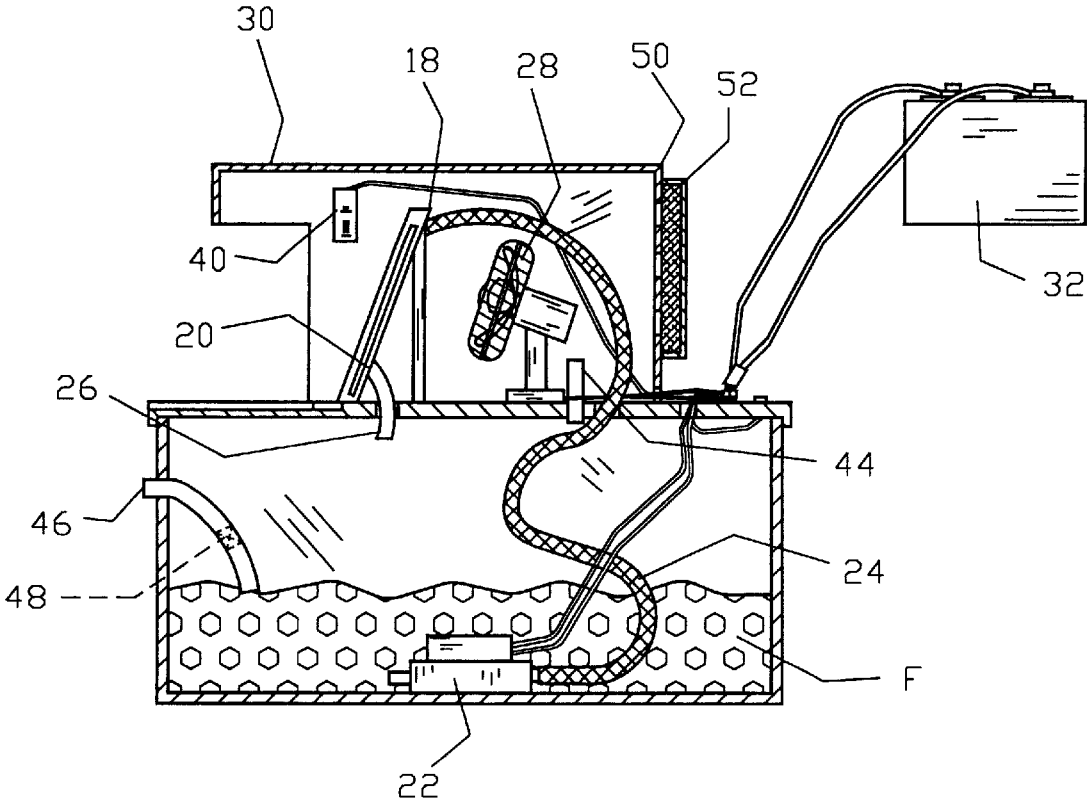
FIG. 3 is a side sectioned view of the cooling system for an ice chest of the present invention.

Referring now to the drawings, it is seen that the cooling system for an ice chest of the present invention, generally denoted by reference numeral 10, is comprised of a container 12 adapted to hold a fluid F, such as water as well as ice, therein. The container 12 can be insulated in normal fashion. A base 14 having a first opening therein, is positioned on the container 12 over an open top of the container 12 and acts as the cover for the container 12. A radiator 16 having an inlet 18 and an outlet 20, is attached to the base 14. A pump 22 is disposed within the container 12 and is in fluid flow communication with the fluid F held within the container 12. A first hose 24 is fluid flow connected with the inlet 18 of the radiator 16 and with the pump 22. A second hose 26 is fluid flow connected with the outlet 20 of the radiator 16, the second hose 26 passes through the first opening. A fan 28 is attached to the base 16 proximate the radiator 16 so that the fan 28 blows across the radiator 16. A plenum 30 is attached to the base 14 and is positioned over the fan 28 and the radiator 16. The plenum 30 can be insulated.

A power source is electrically connected to the fan 28 and to the pump 22. The power source can be a battery 32 or a solar collector 34 of any appropriate design, or both. If both a battery 32 and a solar collector 34 are used, the solar collector 34 can provide trickle down charging of the battery 32. Additionally, the power source can be a plug 36 of either the type that is plugged into a wall outlet in order to receive electrical power or can be a cigarette lighter plug that is plugged into the cigarette lighter outlet of a vehicle in order to receive electrical power. A switch 38 is disposed between the power source and the fan 28 and between the power source and the pump 22 for controlling operation of each element. The switch 38 can be a basic on/off switch for switching both the fan 28 and the pump 22 on and off. Alternately, the switch 38 can be a dual switch that controls each element independently. As a further alternative, the switch 38, whether a single switch or a dual switch can be partially or completely variable so that the speed of the fan 28 and/or the pump 22 can be controlled. Additionally, a thermostat 40 can be electrically connected to the switch 38 for controlling operation of the switch 38 based upon the output reading of the thermostat 40 so that if the temperature read by the thermostat 40 is below (or above if the device is being used for heating) a certain level, the switch 38 will be turned off and if the temperature read is above a certain level, the switch 38 is turned on. If desired, an appropriate timing circuit (not illustrated) can be electrically connected to the switch 38 so that the switch 38 does not rapidly cycle between on and off. Furthermore, appropriate circuitry (not illustrated) can be connected to the thermostat 40 in order to allow a user to set the temperature at which the thermostat 40 is to turn the switch 38 on and off. The thermostat 40 is attached to the plenum 30 proximate the radiator 16.

The container 12 rests upon a drip pan 42. A third hose 44 can be secured within a third opening located in the base 14 while a fourth hose 46 can be secured within a fourth opening located in the container 12. The fourth hose 46 may have a check valve 48 disposed therein. A third opening 50 can be disposed within the plenum 30, while a filter 52 is removably attached to the plenum 30 to cover the third opening 50. A groove 54 is disposed within the base 14 and extends from proximate the radiator 16 to an edge of the base 14 in order to allow any collected fluid to drain away.

In order to use the cooling system for an ice chest 10 of the present invention, a fluid F is placed into the container 12 and the pump 22 is positioned within the container 12 so as to be in fluid flow communication with the fluid F held within the container 12. The fan 28 and the pump 22 are activated causing the pump 22 to draw some of the fluid F from the container 12 and pass it, via the first hose 24, to the radiator 16. The fan 28 blows across the fluid bearing radiator 16 causing cool air (or hot air if the fluid is hot) to blow outwardly. The plenum 30 directs the flow of the air. The fluid F is discharged from the radiator 16 back into the container 12 via the second hose 26. If a third hose 44 is used, the fan 28 will draw at least some of its working air from within the container 12 wherein the air is cooler. The fourth hose 46 allows air to reenter the container 12 so as not to cause a vacuum within the container 12 due to the fan 28 drawing air out of the container 12 via the third hose 44. If the fourth hose 46 is disposed below the fluid line within the container 12 (which causes the incoming air to pass through the cold fluid F making the air within the container 12 even cooler), the check valve 48 prevents fluid from exiting the container 12.

The groove 54 channels away any condensation that forms on the radiator 16 or the plenum 30 and drips onto the base 14. The drip pan 42 catches any such condensation.

While the invention has been particularly shown and described with reference to an embodiment thereof, it will be appreciated by those skilled in the art that various changes in form and detail may be made without departing from the spirit and scope of the invention.

We claim:

1. A cooling system comprising:

a container adapted to hold a fluid therein;

a base positioned on the container;

a radiator having an inlet and an outlet, the radiator attached to the base;

a pump disposed within the container and adapted to be in fluid flow communication with the fluid;

a first hose in fluid flow connected to the inlet of the radiator and to the pump, the first hose passing through the base;

a second hose in fluid flow connected to the outlet of the radiator, the second hose passing through the base;

a fan attached to the base proximate the radiator;

a power source electrically connected to the fan and to the pump; and a plenum attached to the base and positioned over the fan and the radiator.

2. The cooling system as in claim 1 wherein the power source comprises a battery.

3. The cooling system as in claim 1 wherein the power source comprises a solar collector.

4. The cooling system as in claim 1 wherein the power source comprises a plug adapted to be plugged into a source of electrical power.

5. The cooling system as in claim 1 wherein the power source is selected from the group consisting of a battery, a solar collector, and a plug adapted to be plugged into a source of electrical power.

6. The cooling system as in claim 1 further comprising a switch disposed between the power source and the fan and between the power source and the pump.

7. The cooling system as in claim 6 further comprising a thermostat electrically connected to the switch for controlling operation of the switch, the thermostat attached to the plenum proximate the radiator.

8. The cooling system as in claim 1 further comprising a drip pan, the container resting on the drip pan.

9. The cooling system as in claim 1 further comprising a third hose secured within a third opening located in the base.

10. The cooling system as in claim 9 further comprising a fourth hose secured within a fourth opening located in the container.

11. The cooling system as in claim 10 further comprising a check valve disposed within the fourth hose.

12. The cooling system as in claim 1 further comprising a third opening disposed within the plenum.

13. The cooling system as in claim 12 further comprising a filter attached to the plenum covering the third opening.

14. The cooling system as in claim 1 further comprising a groove disposed within the base and extending from proximate the radiator to an edge of the base.

15. The cooling system as in claim 1 wherein the plenum is insulated.

* * * * *